US006130376A

United States Patent [19]

Chang

[11] Patent Number: 6,130,376

[45] Date of Patent: Oct. 10, 2000

[54] LIGATURE FOR REED INSTRUMENTS

[75] Inventor: Shun-Hwa Chang, 40059 Catalina Pl., Fremont, Calif. 94539

[73] Assignee: Shun-Hwa Chang, Fremont, Calif.

[21] Appl. No.: 09/285,627

[22] Filed: Apr. 3, 1999

[51] Int. Cl.[7] ..... G10D 9/02

[52] U.S. Cl. ..... 84/383 R

[58] Field of Search ..... 84/383 R, 383 A; D17/99, 13

[56] References Cited

U.S. PATENT DOCUMENTS

| | | | |
|---|---|---|---|
| D. 367,074 | 2/1996 | Gholson | D17/13 |
| 4,275,636 | 6/1981 | Doren | 84/383 R |
| 4,941,385 | 7/1990 | Johnson | 84/383 R |
| 5,018,425 | 5/1991 | Rovner | 84/383 R |
| 5,623,111 | 4/1997 | Doren et al. | 84/383 R |
| 5,973,245 | 10/1999 | Van Doren | 84/383 R |

*Primary Examiner*—Paul Ip
*Assistant Examiner*—Kim Lockett
*Attorney, Agent, or Firm*—James P. Hillman

[57] ABSTRACT

A universal split ring ligature that is versatile enough to fit differing sized mouthpieces. The ligature of the invention accomplishes this by comprising two elongated inverted U-shaped ring retaining bars that have at least one but preferably two or more apertures disposed therein through the vertical side faces of the U-shape ring retaining bars. Multiple sized metallic (or non-metallic equivalent such as plastic, nylon, etc.) rings or bands having concentric apertures disposed in their opposite ends may be inserted within the U-shaped retaining bars and whereby these opposite ends of the multiple sized rings or bands are drawn together by use of suitable thumbscrews penetrating through said cooperating band and U-shaped ring retaining bars' apertures, so as to unyieldingly embrace and clamp a reed that may be disposed between the ring or band and the mouth piece of the wind instrument.

11 Claims, 5 Drawing Sheets

LIGATURE FOR REED INSTRUMENTS

BACKGROUND OF THE INVENTION

1. Field of the Invention

The invention relates in general to a ligature or reed holding device for a reed instrument and more specifically to a reusable adjustable ligature that may be adjusted for multiple reed instruments.

2. Description of the Related Art

Wind instruments such as the clarinet and saxophone use a mouthpiece that affixes a reed that is free to vibrate and thereby produce a resonating sound. In conventional mouthpieces, the reed is affixed to the mouthpiece by means of a ligature, commonly of the split ring type, whose variety of designs may be exemplified with reference to U.S. Pat. Nos. D390,249; 1,449,868; 4,596,175; and 5,289,753, among others. U.S. Pat. No. 5,289,753 includes a good discussion of related art split ring ligatures. Although all of these devices function to affix a reed to a mouthpiece, it is readily apparent that for each differing mouthpiece, one specific complete ligature must be sized and mounted on each different mouthpiece. In other words, there is little or no interchangability for ligatures of the related art, especially when it comes to different size mouthpieces.

Accordingly, it would be desirable if one universal split ring ligature could be versatile enough to fit differing sized mouthpieces. It would further be desirable if the universal ligature affixed the reed to the mouthpieces with the minimum of surface area and compressive forces necessary to enhance the tone quality produced by the vibrating reed.

SUMMARY OF THE INVENTION

Briefly, the ligature disclosed in the present invention is one universal split ring ligature that is versatile enough to fit differing sized mouthpieces. The ligature of the invention accomplishes this by comprising two elongated inverted U-shaped ring retaining bars that have at least one but preferably two or more apertures disposed therein through the vertical side faces of the U-shape ring retaining bars. Multiple sized metallic (or non-metallic equivalent such as plastic, nylon, etc.) rings or bands having concentric apertures disposed in their opposite ends may be inserted within the U-shaped retaining bars and whereby these opposite ends of the multiple sized rings or bands are drawn together by use of suitable thumbscrews penetrating through said cooperating band and U-shaped ring retaining bars' apertures, so as to unyieldingly embrace and clamp a reed that may be disposed between the ring or band and the mouth piece of the wind instrument. A preferred embodiment of the invention includes a nut capturing means disposed on an outside surface of one vertical side face of one of the U-shaped ring retaining bar to provide a readily manufactured affixed threaded bore for capturing the threaded ends of the thumbscrews. Another preferred embodiment of the invention includes a pliable surface disposed within the ID surface of the rings or bands as well as along the mouthpiece facing surface of the U-shape ring retaining bars to provide a three point grip to the ligature of the invention, to enhance the tone quality produced by the vibrating reed. In like manner, another preferred embodiment of the invention includes multiple projecting bumps disposed along the ID surface of the rings or bands to provide the minimum of surface area and compressive forces necessary to enhance the tone quality produced by the vibrating reed.

BRIEF DESCRIPTION OF THE DRAWINGS

The invention may be understood and further advantages and uses thereof more readily apparent, when considered in view of the following detailed description of the exemplary embodiments, taken with the accompanying drawings, in which.

DESCRIPTION OF THE PREFERRED EMBODIMENTS

Figure 1:
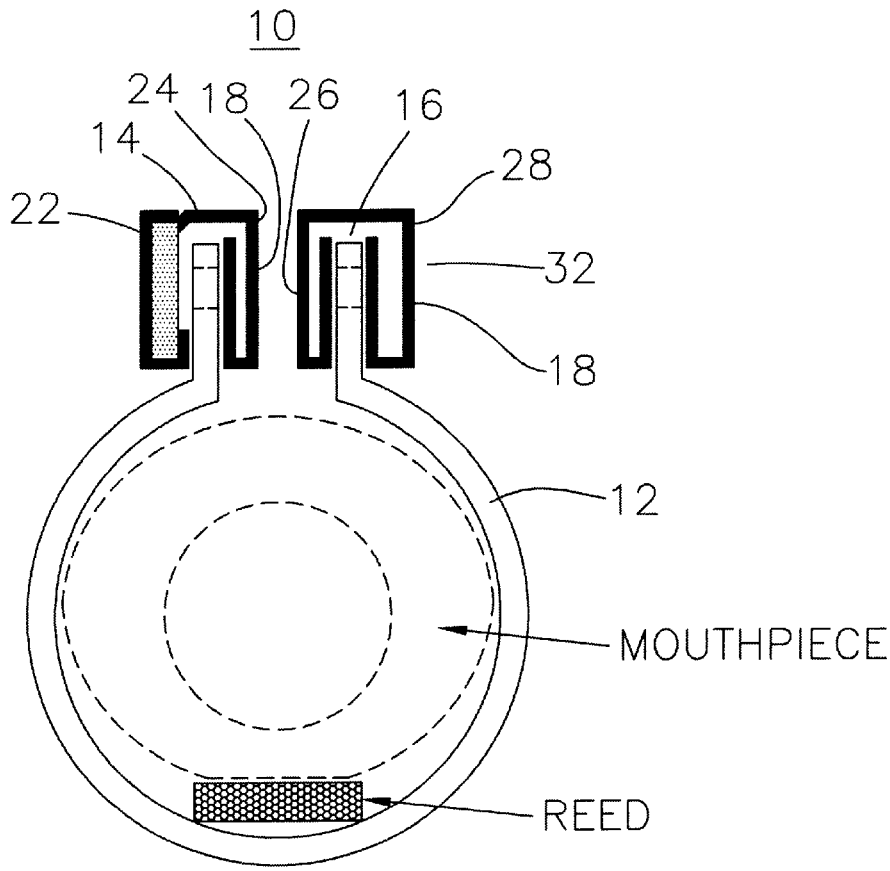
FIG. 1 is a front elevational view of the Ligature constructed according to the teachings of the invention illustrating the band or ring fitted within the two elongated U-shaped ring retaining bars that have at least one but preferably two or more apertures disposed therein through the vertical side faces of the U-shape ring retaining bars. A thumbscrew is shown for drawing the two elongated U-shaped ring retaining bars towards one another so as provide a clamping force within and around a mouthpiece (not shown)
Figure 2:
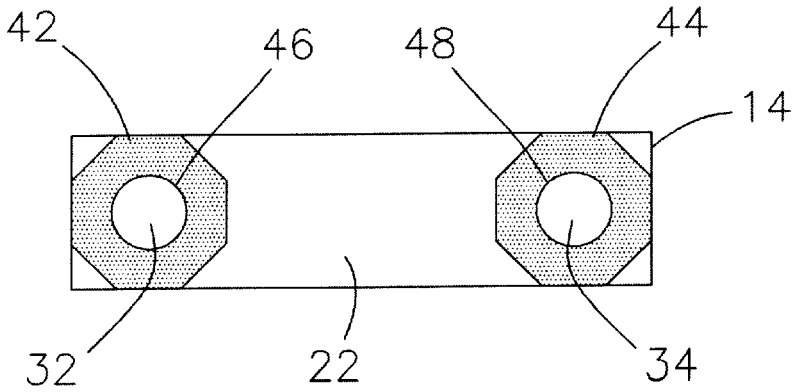
FIG. 2 is an partial side elevational view of the left side of FIG. 1 illustrating the captured nuts disposed on an outside surface of the left vertical side face of the U-shaped ring retaining bar of FIG. 1 to provide a readily manufactured affixed threaded bore for capturing the threaded ends of the thumbscrews.

Referring now to the drawings, and to FIG. 1 in particular, there is shown an front elevational view of the Ligature 10 constructed according to the teachings of the invention illustrating a band or ring 12 fitted within the two elongated U-shaped ring retaining bars 14, 16 respectfully, that have at least one but preferably two or more apertures 18 disposed therein through the vertical side faces 22, 24, 26, 28 respectfully, of the U-shape ring retaining bars 14, 16 respectfully. A thumbscrew 32 ( there is a rear thumbscrew 34 directly behind thumbscrew 32 and therefore not visible in FIG. 1) is shown for drawing the two elongated U-shaped ring retaining bars 16, 18 respectfully, towards one another so as provide a clamping force within and around a mouthpiece (not shown);

Referring now to FIG. 2 there is shown an partial side elevational view of the left side 22 of elongated U-shaped ring retaining bar 14, of FIG. 1 illustrating the captured nuts 42,44 respectfully, disposed on an outside surface of the left vertical side face 22 of the U-shaped ring retaining bar 14 of FIG. 1 to provide readily manufactured affixed threaded bores 46,48 respectfully, for capturing the threaded ends of the thumbscrews 32, 34 respectfully.

Figure 3:
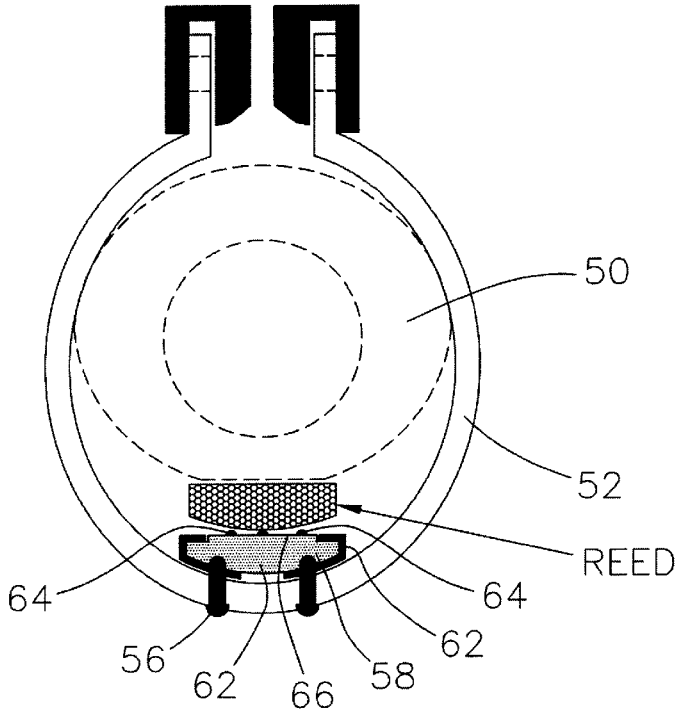
FIG. 3 is a front elevational view of a band or ring constructed according to the teachings of the invention, illustrating a reed resilient support contact block that is disposed along the ligature band or ring at a predetermined position to coincide with the placement of the clamped/supported reed for placing the ligature bound reed in resilient contact support.

Referring now to FIG. 3 there is shown a front elevational view of a band or ring 52 constructed according to the teachings of the invention, and circumscribing a mouthpiece shown drawn in phantom at 50 illustrating a reed resilient support contact block 54 that is disposed along the ligature band or ring at a predetermined position to coincide with the placement of the clamped/supported reed for placing the ligature bound reed in resilient contact support. Support block 54 includes resilient support pads 56,58 respectfully that are disposed on the bottom 62 of support block 54 so as to place support block 54 in resilient contact support with ring/band 52. Support block 54 further includes multiple resilient pads 64 disposed on top surface 66 so as to provide resilient contact with the ligature bound reed.

Figure 3A:
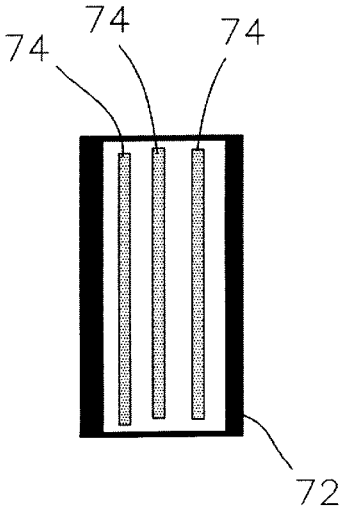
FIG. 3A is a top plan view of one preferred embodiment of a reed resilient support contact block constructed according to the teachings of the invention, illustrating a longitudinal row of resilient reed support/contact material.
Figure 3B:
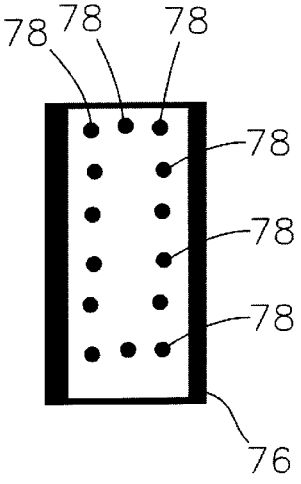
FIG. 3B is a top plan view of one preferred embodiment of a reed resilient support contact block constructed according to the teachings of the invention, illustrating multiple-spaced support pedestals of resilient reed support/contact material.
Figure 3C:
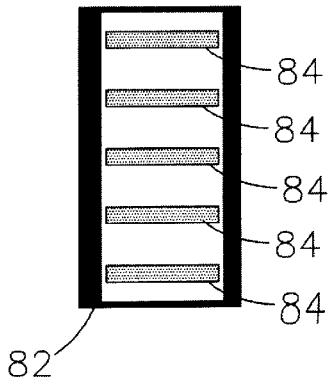
FIG. 3C is a top plan view of one preferred embodiment of a reed resilient support contact block constructed according to the teachings of the invention, illustrating a transverse row of resilient reed support/contact material.

Referring now to FIG. 3A there is shown a top plan view of one preferred embodiment of a reed resilient support contact block 72 constructed according to the teachings of the invention, illustrating longitudinal rows 74 of resilient reed support/contact material such as rubber, pliable plastic, silicon etc. Referring now to FIG. 3B there is shown a top plan view of another preferred embodiment of a reed resilient support contact block 76 constructed according to the teachings of the invention, illustrating multiple-spaced support pedestals 78 of resilient reed support/contact material so as to provide resilient contact with the ligature bound reed. Referring now to FIG. 3C there is shown a top plan view of another preferred embodiment of a reed resilient support contact block 82 constructed according to the teachings of the invention, illustrating a transverse row 84 of resilient reed support/contact material so as to provide resilient contact with the ligature bound reed.

Figure 4:
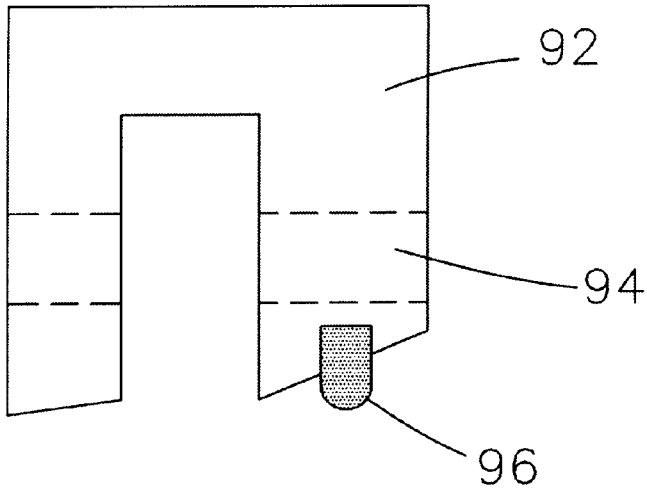
FIG. 4 is and end view of an elongated U-shaped ring retaining bar that have at least one but preferably two or more apertures disposed therein through the vertical side faces of the U-shape ring retaining bars, illustrating a projection of resilient material for contact with a wind instrument mouthpiece.
Figure 5:
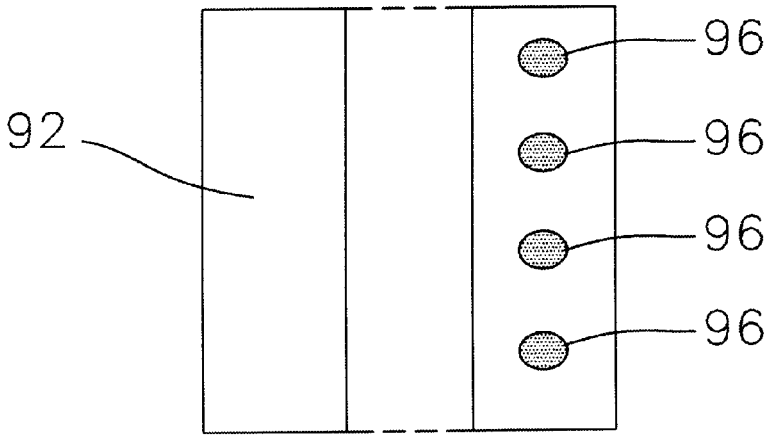
FIG. 5 is a bottom longitudinal view of the elongated U-shaped ring retaining bar of FIG. 1 that has at least one but preferably two or more apertures disposed therein through the vertical side faces of the U-shape ring retaining bars, illustrating a row of multiple projections of resilient material for contact with a wind instrument mouthpiece.

FIG. 4 is and end view of an elongated U-shaped ring retaining bar 92 that has at least one but preferably two or more apertures 94 disposed therein through the vertical side faces of the U-shape ring retaining bar 92, illustrating a projection 96 of resilient material for contact with a wind instrument mouthpiece. Referring now to FIG. 5 there is shown a bottom longitudinal view of the elongated U-shaped ring retaining bar 92 of FIG. 4 that has at least one but preferably two or more apertures 94 disposed therein through the vertical side faces of the U-shape ring retaining bar 92, illustrating a row of multiple projections 96 of resilient material for contact with a wind instrument mouthpiece. Referring now to FIGS. 3, 3A, 3B, 3C, 4 and 5, it can be readily appreciated that the ligature of the invention has a 3 point stance for resiliently supporting a reed on a mouthpiece (both reed and mouthpiece not shown).

Figure 6:
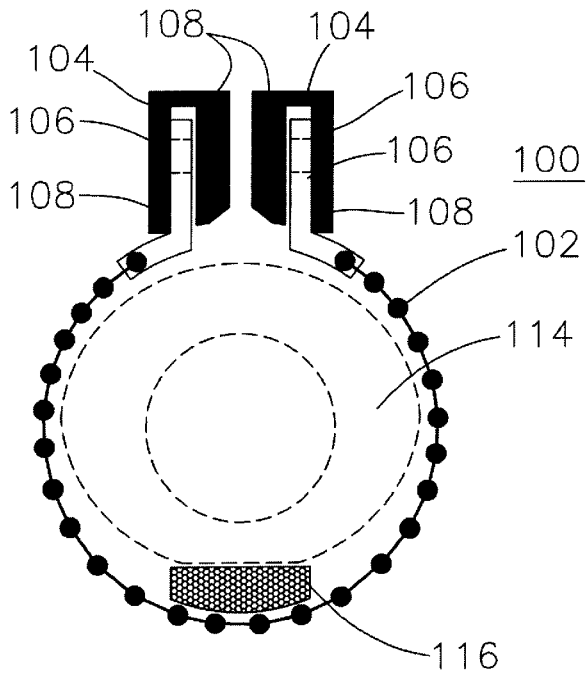
FIG. 6 is a front elevational view of another Ligature constructed according to the teachings of the invention illustrating beaded chain band or ring fitted within the two elongated U-shaped ring retaining bars that have at least one but preferably two or more apertures disposed therein through the vertical side faces of the U-shape ring retaining bars. A thumbscrew is shown for drawing the two elongated U-shaped ring retaining bars towards one another so as provide a clamping force within and around a mouthpiece.
Figure 7:
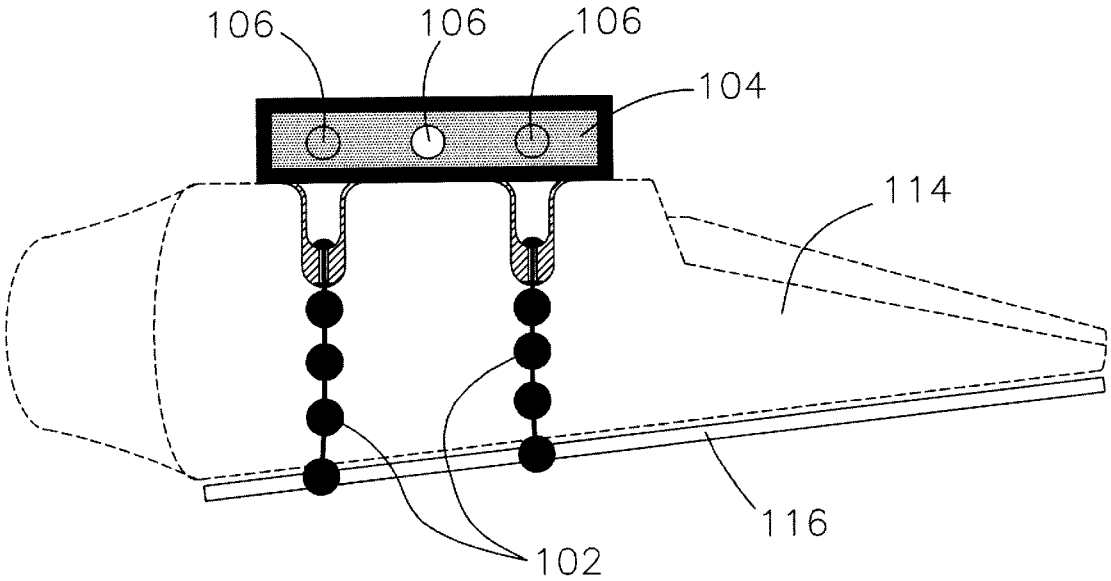
FIG. 7 is a side elevational view of the Ligature constructed according to the teachings of the invention illustrating the two beaded chain bands or rings fitted within the two elongated U-shaped ring retaining bars that have at least one but preferably two or more apertures disposed therein through the vertical side faces of the U-shape ring retaining bars. This time the thumbscrews are not shown for drawing the two elongated U-shaped ring retaining bars towards one another so as provide a clamping force within and around a mouthpiece.

Referring now to FIG. 6 there is shown a front elevational view of another Ligature 100 constructed according to the teachings of the invention illustrating beaded chain band or ring 102 fitted within the two elongated U-shaped ring retaining bars 104 (only one is shown in FIG. 6, both are shown in FIG. 7) that have at least one but preferably two or more apertures 106 (both shown in FIG. 7) disposed therein through the vertical side faces 108 of the U-shape ring retaining bars 104. A thumbscrew 112 is shown for drawing the two elongated U-shaped ring retaining 104 bars towards one another so as provide a clamping force within and around a mouthpiece shown drawn in phantom at 114 to provide for biasing reed support 116.

FIG. 7 is a side elevational view of the Ligature 100 of FIG. 6 constructed according to the teachings of the invention illustrating the two beaded chain bands or rings 102 fitted within the two elongated U-shaped ring retaining bars 106 (only 1 is shown in FIG. 7, both are shown in FIG. 6) that have at least one but preferably two or more apertures 106 disposed therein through the vertical side faces 108 of the U-shape ring retaining bars 104. This time the thumbscrews are not shown for drawing the two elongated U-shaped ring retaining bars 104 towards one another so as provide a clamping force within and around a mouthpiece 114 and placing a compressive bias upon reed support 116.

Figure 8:
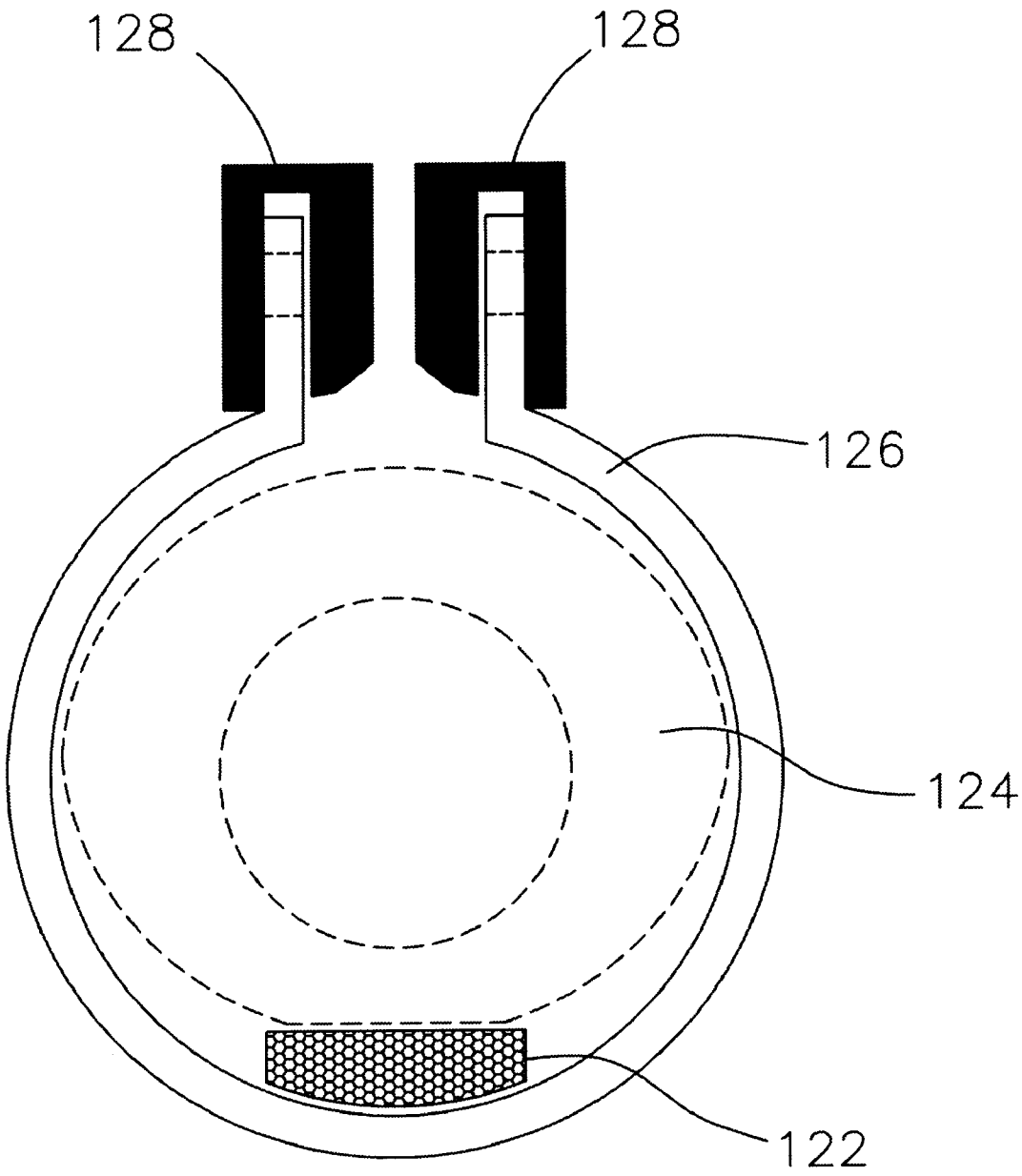
FIG. 8 is another front elevational view of a simplified Ligature of the invention illustrating a reed and mouthpiece circumscribed by a band or reed and one or two band receiving means for receiving and applying a tightening bias to the ends of the circumscribed band.

In conclusion, what has been disclosed is a universal split ring ligature that is versatile enough to fit differing sized mouthpieces. The ligature of the invention accomplishes this by comprising two elongated inverted U-shaped ring retaining bars that have at least one but preferably two or more apertures disposed therein through the vertical side faces of the U-shape ring retaining bars. Multiple sized metallic (or non-metallic equivalent such as plastic, nylon, etc.) rings or bands having concentric apertures disposed in their opposite ends may be inserted within the U-shaped retaining bars and whereby these opposite ends of the multiple sized rings or bands are drawn together by use of suitable thumbscrews penetrating through said cooperating band and U-shaped ring retaining bars' apertures, so as to unyieldingly embrace and clamp a reed that may be disposed between the ring or band and the mouth piece of the wind instrument. Although the preferred embodiments illustrate the teachings of the invention quite well, it is to be understood that the invention is not to be limited thereto. Rather, the invention is broadly applicable to any two piece ligature, one clamping support and one flexible circumscribing ring. Referring now to FIG. 8 there is shown another front elevational view of a simplified Ligature 120 of the invention illustrating a reed 122 and mouthpiece 124 circumscribed by a band or ring 126 and one or two band receiving means 128 for receiving and applying a tightening bias to the ends of the circumscribed band 126.

I claim:

1. An interchangeable two piece ligature for holding reeds against different sized wind instrument mouthpieces, comprising:

a) a first piece being at least one interchangeable flexible band or ring for circumscribing both said mouthpiece and said reed, said flexible band having first and second ends, each of said first and second ends having an aperture disposed therein; and b) a second piece being at least one compressible receiving means including a strip of resilient material having two rectangular receiving channels with apertures disposed therein for receiving the apertures of both said first and second ends of said flexible band and moving said first and second ends toward each other to provide for placing said flexible band in tension so to provide a biasing means having interchangeable flexible bands or rings for holding said one or differing reeds against different sized mouth pieces.

2. The interchangeable two piece adjustable ligature for holding reeds against different sized wind instrument mouth pieces of claim 1 wherein said flexible band is made from materials taken from the group of nylon, fiberglass, metals, graphite and other like natural and synthetic materials and wherein said first and second apertures are for receiving an elongated attachment means such as a thumbscrew.

3. The interchangeable two piece adjustable ligature for holding reeds against different sized wind instrument mouth pieces of claim 2 wherein said compressible receiving means includes two rigid u-shaped channels separated by an adjacent space, each of said rigid u-shaped channels having apertures disposed therein.

4. The interchangeable two piece adjustable ligature for holding reeds against different sized wind instrument mouth pieces of claim 3, further including at least two thumbscrews and associated thread receiving means, said apertures, thread receiving means and thumbscrews cooperate to provide for assembling the thumbscrews through the apertures and the first and second ends of the flexible band or ring into the thread receiving means which by tightening said thumbscrews then puts the flexible bands into tension thereby biasing said reed against said wind instrument mouthpiece.

5. The interchangeable two piece adjustable ligature for holding reeds against different sized wind instrument mouth pieces-of claim 4, further including a reed plate having a flat longitudinal side for disposing between the mouthpiece and the flexible bands.

6. The interchangeable two piece adjustable ligature for holding reeds against different sized wind instrument mouth pieces of claim 5, further including small surface pliable reed engagement means disposed on the flat longitudinal side of said reed plate for engaging with the reed with a firm biased minimized surface area to provide for maintaining a firm grip and stable position of the reed on the mouthpiece without interfering with its vibrations.

7. The interchangeable two piece adjustable ligature for holding reeds against different sized wind instrument mouth pieces of claim 6 wherein said reed engagement means are a multiplicity of individual pods disposed in a rectangular periphery on the flat longitudinal side of said reed plate.

8. The interchangeable two piece adjustable ligature for holding reeds against different sized wind instrument mouth pieces of claim 7 wherein said reed engagement means are a multiplicity of long strips disposed parallel to the longitudinal side of the flat longitudinal reed plate.

9. The interchangeable two piece adjustable ligature for holding reeds against different sized wind instrument mouth pieces of claim 8 wherein said reed engagement means are a multiplicity of long strips disposed transverse to the longitudinal side of the flat longitudinal side of said reed plate.

10. The interchangeable two piece adjustable ligature for holding reeds against different sized wind instrument mouth pieces of claim 1 wherein said flexible band includes a flexible beaded chain.

11. The interchangeable two piece adjustable ligature for holding reeds against different sized wind instrument mouth pieces of claim 10, further including a bead receptacle strap having first and second ends, said first end having a bead receptacle for receiving an end bead of said beaded chain, and said second end having a flattened surface with an aperture disposed therein for attachment to said compressible receiving means.

* * * * *